United States Patent [19]

Bassford et al.

[11] Patent Number: 4,816,217

[45] Date of Patent: Mar. 28, 1989

[54] HIGH-STRENGTH ALLOY FOR INDUSTRIAL VESSELS

[75] Inventors: Thomas H. Bassford, Huntington; James R. Crum, Ona, both of W. Va.

[73] Assignee: Inco Alloys International, Inc., Huntington, W. Va.

[21] Appl. No.: 854,340

[22] Filed: Apr. 21, 1986

Related U.S. Application Data

[63] Continuation-in-part of Ser. No. 590,393, Mar. 16, 1984, abandoned.

[51] Int. Cl.[4] ..... C22C 30/02; C22C 38/42

[52] U.S. Cl. ..... 420/582; 420/584; 420/49; 420/53; 148/442; 148/327

[58] Field of Search ..... 420/582, 584, 586, 49, 420/52, 53, 54, 57, 58; 148/442, 419, 326, 327

[56] References Cited

U.S. PATENT DOCUMENTS

| | | | |
|---|---|---|---|
| 3,168,397 | 2/1965 | Scharfsten | 420/53 |
| 3,492,117 | 1/1970 | Jackson et al. | 75/128 |
| 4,201,574 | 5/1980 | Kowaka et al. | 420/52 |

FOREIGN PATENT DOCUMENTS

| | | |
|---|---|---|
| 420305 | 12/1971 | Australia . |
| 2528610 | 1/1976 | Fed. Rep. of Germany . |
| 18415 | 11/1935 | Finland . |
| 23286 | 7/1949 | Finland . |
| 2330776 | 6/1977 | France . |
| 708820 | 5/1954 | United Kingdom . |
| 812582 | 4/1959 | United Kingdom . |

OTHER PUBLICATIONS

Verlag Stahlschüssel Wegst KG., "Key to Steels", W. Germany, 10 edition, 1974.

"Development of New Alloy SCR-3 Resistant to Stress Corrosion Cracking in High Temperature High Pressure Water", by M. Kowaka, H. Fujikawa and T. Kobayashi.

"Carpenter 20CB-3 ® Stainless Steel".

*Primary Examiner*—Deborah Yee

*Attorney, Agent, or Firm*—Raymond J. Kenny; Edward A. Steen

[57] ABSTRACT

An austenitic, age-hardenable nickel-iron-chromium alloy exhibiting high-strength, good corrosion and polythionic acid resistance and having a low work hardening rate. The economic alloy is useful for industrial vessels such as heat exchangers, chemical and petrochemical equipment and, more particularly, tubes. The alloy includes about 25-29.5% nickel, about 14.5-17.5% chromium, about 2-3.5% molybdenum, about 2-5.5% copper, about 1-5% titanium plus aluminum, up to about 1.5% manganese, up to about 0.1% cerium, and the balance mostly iron.

12 Claims, 1 Drawing Sheet

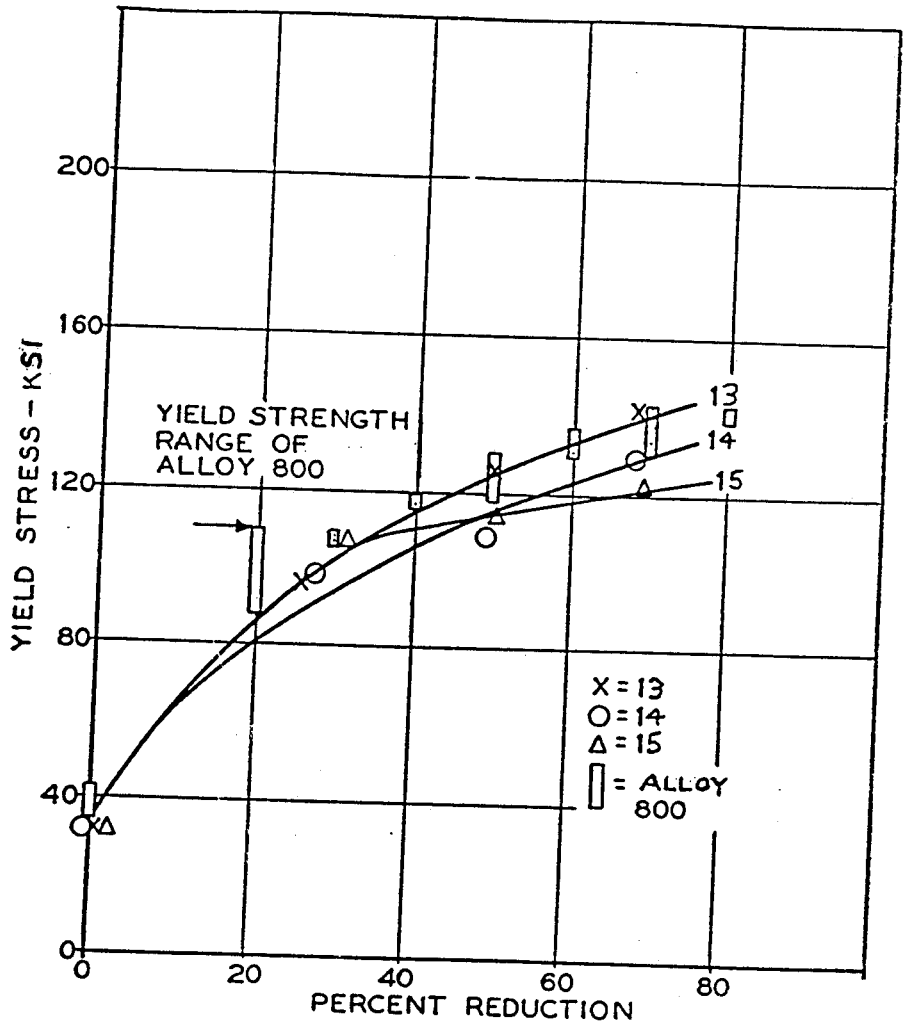
YIELD STRESS - KSI
200
160
120
80
40
0
0
20
40
60
80
PERCENT REDUCTION
YIELD STRENGTH
RANGE OF
ALLOY 800
13
14
15
X = 13
O = 14
Δ = 15
▯ = ALLOY
800

HIGH-STRENGTH ALLOY FOR INDUSTRIAL VESSELS

This application is a continuation-in-part of prior U.S. application Ser. No. 590,393, filed Mar. 16, 1984, now abandoned.

TECHNICAL FIELD

The instant invention relates to nickel-iron-chromium alloys in general and more particularly to a high strength, age hardenable, austenitic alloy having a low work hardenability rate. The alloy reduces copper pickup in fluid streams. The alloy exhibits resistance to polythionic acid and chloride stress corrosion attack.

BACKGROUND ART

Power plant operators and boiler manufacturers recognized early on that to improve the efficiency of steam generators (both fossil and nuclear), it was useful to adopt regenerative feedwater heating. Essentially, steam is extracted from the steam turbines to preheat the boiler/reactor feedwater before it is introduced into the economizer of a boiler or directly into a steam generator/reactor. The heating of the feedwater occurs in, naturally enough, feedwater heaters. Steam is used to heat the feedwater inside the feedwater heater tubing to impart a portion of the steam's latent heat to the water. Water temperatures from about 100°–650° F. (37.7°–343.3° C.) and pressures up to 5200 psi (358.53 MPa) are not uncommon. Moreover, advances designs are now contemplating pressures up to 7200 psi (496.42 MPa) and 700° F. (371.1° C.).

Currently, steels (carbon and stainless) and sometimes nickel-copper alloys are utilized in feedwater heaters. Although the feedwater is treated to remove chemicals and other impurities, corrosion of the tubing may still occur.

Superalloys are often difficult to form into tubes due to their high work hardening rates. High copper-containing materials are generally frowned upon since copper and corrosion products are believed to deposit on boiler tubes and may be carried over into the steam. These undesirable entrained products may enter into the turbines resulting in lower efficiencies. Indeed, operators wish to eliminate all possible copper pickup in the steam because of fouling and the resulting loss of efficiency of the turbine blades when the copper plates out of the steam. It is also believed that the copper deposits may set up local galvanic cells with the ferrous alloys thereby causing additional corrosion. Operators wish to stay away from nickel-copper alloys which otherwise display better chemical and physical properties than the other alloys. However, the substitution of low carbon or stainless steels for the nickel-copper alloys currently available are not always satisfactory since these materials do not have the requisite corrosion resistance, stress corrosion cracking resistance or strength. This leads to high maintenance costs. Moreover, in the case of carbon steels, undesirably short lifetimes of three to eight years have been reported. Contrast this state of affairs with an expected service life in excess of twenty years. Accordingly, power plant operators are in a quandry: steels corride; high alloys are costly; and the nickel-copper alloys contain high quantities of copper.

In addition, petrochemical installations employing piping and tubing are often subject to polythionic acid ($H_2S_xO_6$) cracking. Intergranular cracking is believed to be caused by the depletion of chromium along the grain boundaries.

The upshot of all this is that an alloy exhibiting the requisite physical and chemical characteristics should also have a low workability rate. In this fashion, the amount of time and effort needed to process the resultant tubing is greatly reduced. Indeed, many suitable alloys displaying good corrosion characteristics, because of their high work hardening rates, require additional thermomechanical processing steps in order to manufacture suitable tubing.

For example, now expired U.S. Pat. No. 3,168,397 marketed as alloy 20Cb-3 ® (a trademark of Carpenter Technology Corp.) and U.S. Pat. No. 4,201,574 (identified as alloy SCR-3) have been suggested as suitable tubing alloys. A paper entitled "Development of New Alloy SCR-3 Resistant to Stress Corrosion Cracking in High Temperature High Pressure Water" by M. Kowaka, H. Fujikawa, and T. Kobayashi, Golden Gate Metals and Welding Conference, San Francisco 1979, further explains alloy SCR-3. These austenitic alloys, is the as cold worked condition, have higher tensile properties and lower ductility than the instant age-hardenable alloy that necessitate additional processing steps. Test data, included herein, indicate that the instant alloy is more easily fabricated into tubular shapes, thereforee necessitating lower manufacturing costs.

These austenitic alloys are supplied in the annealed condition at relatively low tensile strengths in order to resist stress corrosion cracking and to be capable of making small radii tube bends. On the other hand, the instant age hardenable alloy may be cold worked to greater levels of cold work and thereby eliminating expensive processing steps as will be shown later. Then by nature of the age-hardening capability the instant alloy may be heat treated to a higher level of tensile strength and still resist stress corrosion cracking and maintain adequate ductility to make tight U-bends. Tubing exhibited 25% tensile elongation is marginal and tubing with 18% elongation or less nearly always fails small radii bending.

It is apparent that there is a need for a resonable cost, age-hardenable alloy that exhibits corrosion resistance, strength and formability properties suitable for feedwater heaters, chemical and petrochemical installations and other similar applications.

SUMMARY OF THE INVENTION

Accordingly, there is provided an austenitic alloy having a low work hardening rate especially suited for, but not limited to, heat exchanger tubing for high temperature, high pressure applications and petrochemical installations subject to polythionic acid cracking. The instant alloy combines improved corrosion resistance and the requisite high strength in a system that is of lower cost than the more expensive higher alloys. The alloy displays good stress corrosion cracking resistance, good high temperature corrosion resistance and polythionic acid cracking resistance.

Due to its low work hardenability rate, (caused in part by the nickel-chromium combination) the instant age-hardenable alloy easily lends itself to tube fabrication and other cold working operations.

The alloy broadly includes about 25–29.5% nickel, about 14.5–17.5% chromium, about 2–3.5% molybdenum, about 2–5.5% copper, up to about 2.5% titanium, up to about 2.5% aluminum, about 1–5% titanium plus aluminum, up to about 1.5% manganese, up to about 0.1% cerium, up to about 1% columbium, up to about 0.2% nitrogen, the balance iron, and other minor impurities and processing aids (such as calcium, boron [up to about 0.01%], silicon [up to about 0.75%], etc.).

BRIEF DESCRIPTION OF THE DRAWINGS

The FIGURE plots yield stress vs. percent reduction.

PREFERRED MODE FOR CARRYING OUT THE INVENTION

The addition of a measured quantity of titanium imparts an age hardening response of at least 60 ksi (413.7 MPa) yield strength and 120 ksi (827.4 MPa) tensile strength in the cold worked and annealed conditions. Copper, chromium and molybdenum improve the corrosion resistance of the alloy. Aluminum, cerium, boron and calcium assist in the deoxidation of the alloy. Aluminum is necessary to control the titanium during remelting operations. Otherwise, the titanium would oxidize and not contribute the desired characteristics to the alloy. Experience has shown that static cast solid products may experience centerline cracking and porosity. It appears that a remelting step may be required to ensure the integrity of the form. Accordingly, the aluminum is added to accommodate the remelting step. Additionally, aluminum also imparts age hardening properties to the instant alloy.

Nitrogen may be added to the low titanium level alloys as an austenite former. It also serves to boost the alloy's ability to withstand corrosive attack. The nitrogen raises the strength and increases the work hardening rate of the alloy in the annealed condition. Table I below sets forth a number of heats.

EXAMPLE 1

The heats listed in Table I except heats 21, 22, 24, 30 and 31, were vacuum melted and cast to 4 inch (10.16 cm) diameter ingots. Forged 9/16 inch (1.43 cm) squares plus forged ¾×2×12 inch (1.91×5.08×30.48 cm) flats were made with frequent reheats at 2150° F. (1177° C.). Afer overhauling the flats to a uniform thickness, they were hot rolled to ¼ inch (0.64 cm) at 2150° F. Test material for heats 21, 22, 24 and 31 were taken from air melted large scale ingots and processed similarly. The processing is not known for commercial heats No. 30 or the type 304, 321 or 347 stainless steels (discussed hereinafter). The hot rolled ¼ inch strip was annealed at 1950° F. (1066° C.)/one hour water quench and pickled prior to cold rolling. Hardness and tensile tests were taken at various levels of cold work to establish a work hardening response. A low work hardening rate is very desirable in the manufacture of relatively small diameter thin-walled tubing.

Of particular importance is the yield strength of high levels of cold reduction such as 60 to 90% reduction. Many tube mills produce a large hot-worked tube shell which must be reduced in size during a number of cold working and annealing stages. Experience has shown that alloys which have lower yield strength after high cold reductions may be cold worked to a greater degree without splitting, requirng less annealing stages and lower manufacturing costs. The FIGURE shows heat 15 to have a lower yield strength after a high cold reduction than heats 13 and 14 with lower nickel contents.

After a cold reduction of 60 to 80%, the yield strength of heat 15 is also lower than alloy 800. Alloy 800 is shown in the FIGURE for comparative purposes only. A general purpose alloy, it has good workability

TABLE I

| Heat No. | Chemical Analysis % Weight | | | | | | | | | | | | | | | | |
|---|---|---|---|---|---|---|---|---|---|---|---|---|---|---|---|---|---|
| | C | Mn | Fe | S | Si | Cu | Ni | Cr | Al | Ti | Mg | Co | Mo | Cb + Ta | Ce | N | V |
| 1 | 0.01 | 0.93 | Bal. | 0.003 | 0.36 | 3.57 | 28.32 | 16.24 | 0.08 | 1.75 | — | 0.02 | 2.08 | 0.02 | 0.03 | — | — |
| 2 | 0.02 | 0.95 | Bal. | 0.003 | 0.42 | 3.42 | 28.75 | 15.94 | 0.08 | 2.02 | — | 0.02 | 2.10 | 0.01 | 0.039 | — | — |
| 3 | 0.04 | 0.96 | Bal. | 0.003 | 0.42 | 3.57 | 28.59 | 15.59 | 0.08 | 2.30 | — | 0.02 | 2.11 | 0.01 | 0.038 | — | — |
| 4 | 0.02 | 1.00 | 51.56 | 0.002 | 0.43 | 0.03 | 28.60 | 16.29 | 0.06 | 1.78 | <0.001 | <0.01 | 0.03 | 0.05 | 0.046 | .005 | — |
| 5 | 0.03 | 0.96 | 50.72 | 0.002 | 0.34 | <0.01 | 28.11 | 15.63 | 0.07 | 1.78 | — | 0.01 | 1.96 | 0.02 | 0.043 | .006 | — |
| 6 | 0.02 | 0.99 | 48.84 | 0.003 | 0.40 | 4.07 | 28.13 | 15.93 | 0.04 | 1.10 | — | 0.01 | 0.04 | <0.01 | 0.041 | .004 | — |
| 7 | 0.02 | 0.98 | 47.40 | 0.003 | 0.40 | 3.86 | 27.98 | 15.92 | 0.05 | 0.83 | — | <0.01 | 3.08 | 0.01 | 0.036 | .004 | — |
| 8 | 0.02 | 1.00 | 46.52 | 0.001 | 0.45 | 3.98 | 28.05 | 15.68 | 0.02 | 1.79 | <0.001 | 0.01 | 2.05 | 0.01 | 0.026 | — | — |
| 9 | 0.02 | 1.02 | 44.55 | 0.001 | 0.45 | 5.03 | 28.03 | 15.69 | 0.03 | 1.78 | <0.001 | 0.01 | 3.02 | 0.01 | 0.022 | — | — |
| 10 | 0.03 | 0.91 | 45.72 | 0.004 | 0.45 | 5.03 | 27.95 | 15.80 | 0.02 | 0.74 | <0.001 | 0.02 | 3.09 | 0.01 | 0.009 | — | — |
| 11 | 0.03 | 0.99 | 47.17 | 0.002 | 0.44 | 4.11 | 27.88 | 15.54 | 0.04 | 0.76 | <0.001 | 0.01 | 2.07 | 0.49 | 0.030 | — | — |
| 12 | 0.02 | 1.00 | Bal. | 0.001 | 0.43 | 3.84 | 18.24 | 16.06 | 0.05 | 0.06 | — | 0.01 | 2.03 | <.01 | 0.029 | .12 | — |
| 13 | 0.03 | .95 | Bal. | 0.003 | 0.38 | 3.66 | 12.86 | 14.76 | 0.05 | 0.03 | — | 0.02 | 1.92 | .01 | 0.037 | 0.017 | — |
| 14 | 0.02 | .98 | Bal. | 0.002 | 0.40 | 3.63 | 17.63 | 15.68 | 0.06 | 0.04 | — | 0.02 | 2.03 | <.01 | 0.028 | 0.004 | — |
| 15 | 0.03 | .95 | Bal. | 0.003 | 0.42 | 3.38 | 27.03 | 16.52 | 0.06 | 0.03 | — | 0.02 | 2.03 | — | 0.041 | — | — |
| 16 | 0.03 | 0.95 | Bal. | 0.003 | 0.38 | 3.66 | 12.86 | 14.76 | 0.05 | 0.03 | — | 0.02 | 1.92 | .01 | 0.03 | — | — |
| 17 | 0.02 | 0.98 | Bal. | 0.002 | 0.40 | 3.63 | 17.63 | 15.68 | 0.06 | 0.04 | — | 0.02 | 2.03 | <.01 | 0.028 | — | — |
| 18 | 0.02 | 0.99 | Bal. | 0.003 | 0.40 | 3.88 | 17.98 | 19.41 | 0.06 | 0.03 | — | 0.02 | 2.11 | — | 0.26 | — | — |
| 19 | 0.02 | 1.01 | Bal. | 0.002 | 0.40 | 4.02 | 18.24 | 23.47 | 0.05 | 0.03 | — | 0.02 | 2.04 | — | 0.23 | — | — |
| 20 | 0.03 | 0.95 | Bal. | 0.003 | 0.42 | 3.38 | 27.03 | 16.52 | 0.06 | 0.03 | — | 0.02 | 2.03 | — | 0.41 | — | — |
| 21 | 0.04 | 0.87 | Bal. | 0.007 | 0.34 | 0.39 | 33.22 | 20.49 | 0.35 | 0.50 | — | — | — | — | — | — | — |
| 22 | 0.03 | 0.27 | Bal. | 0.007 | 0.60 | 0.25 | 20.64 | 19.67 | 0.37 | 0.43 | — | — | — | — | — | — | — |
| 23 | 0.02 | 1.05 | Bal. | 0.002 | 0.41 | 3.56 | 36.18 | 16.04 | 0.02 | 0.06 | — | — | 2.04 | — | 0.036 | — | — |
| 24 | 0.015 | 0.97 | Bal. | 0.002 | 0.42 | 3.54 | 27.49 | 15.92 | 0.11 | 1.64 | — | 0.35 | 2.01 | <.01 | 0.004 | — | — |
| 25 | 0.03 | 1.51 | Bal. | 0.005 | 1.89 | <.01 | 26.54 | 23.00 | 0.01 | 0.28 | — | 0.03 | 0.04 | <.01 | — | — | 1.20 |
| 26 | 0.04 | 1.09 | Bal. | 0.003 | 0.51 | 3.13 | 34.20 | 22.49 | 0.03 | 0.05 | — | 0.03 | 2.90 | 0.79 | <.01 | — | 0.13 |
| 27 | 0.02 | 0.91 | Bal. | 0.004 | 1.97 | 0.19 | 39.65 | 31.89 | <.01 | <.01 | — | 0.03 | 2.50 | 0.65 | <.01 | — | 2.30 |
| 28 | 0.06 | 1.01 | Bal. | 0.003 | 0.52 | 3.07 | 34.63 | 23.34 | 0.077 | 1.65 | — | 0.03 | 2.73 | 0.78 | — | — | 0.04 |
| 29 | 0.014 | 1.47 | Bal. | 0.004 | 1.98 | 0.16 | 26.77 | 25.54 | 0.024 | 1.58 | — | 0.03 | 0.14 | 0.04 | — | — | 1.29 |
| 30 | 0.03 | .23 | Bal. | 0.003 | 0.36 | 3.29 | 33.10 | 19.77 | — | — | — | — | 2.23 | 0.80 | — | — | — |
| 31 | 0.01 | 1.05 | Bal. | 0.001 | 0.45 | 3.89 | 28.45 | 15.70 | 0.05 | 1.81 | — | 0.01 | 2.06 | <0.01 | — | — | — |

characteristics and is easily processed. The instant invention was developed with these attributes in mind.

Additional data on the cold workability of a number of the heats is presented in Table II below.

TABLE II

Tensile and Tear Strength of 75% CR Strip, .066 Gage Hot Rolled @ 2050° F. + 1950° F./30 min.

| Heat No. | YS ksi | TS ksi | El. % | TS/YS Ratio | Notched Tear Strength Transverse ksi | Notched Tear Strength Longitudinal ksi | Trans. Tear Str. to Yield Str. Ratio |
|---|---|---|---|---|---|---|---|
| 7 | 133.7 | 146.2 | 3.5 | 1.09 | 173.3 | 201.1; 198.7 | 1.30 |
| 10 | 129.2 | 146.0 | 4.0 | 1.13 | 193.8 | 198.7; 203.2 | 1.50 |
| 11 | 136.9 | 147.4 | 5.0 | 1.08 | 176.3 | 188.9; 201.1 | 1.29 |
| 4 | 135.8 | 150.9 | 5.0 | 1.11 | 163.0 | 195.4; 190.7 | 1.20 |
| 6 | 128.1 | 140.2 | 3.5 | 1.10 | 164.9 | 190.9; 191.4 | 1.29 |
| 5 | 140.8 | 156.0 | 3.5 | 1.11 | 172.2 | 207.2; 208.0 | 1.22 |
| 8 | 140.0 | 152.0 | 3.5 | 1.09 | 186.1 | 210.6; 206.9 | 1.33 |
| 9 | 142.4 | 154.9 | 4.5 | 1.09 | 192.1 | 211.2; 219.8 | 1.35 |

Of particular interest was the apparent tendency of copper to increase the tear resistance of heavily cold worked strip. This is important in the manufacture of tubing.

The capability of an alloy to be cold reduced in the laboratory was performed on strip samples about 3 inches wide. After the strip was cold rolled to a high level of deformation both longitudinal and transverse tear tests were performed. In addition longitudinal tensile tests were also performed to establish the yield strength for each sample and composition. The results of these tests are given in Table II above.

Upon examination of this data it will be noted that the transverse tear strength increases with increasing copper content. In addition to the increase in tear strength there is a trend of higher yield strengths. This increase in yield strength is believed to be due to the increase in molybdenum content. To add credence to this reasoning note that the yield strength does not change for heats 5 and 8 at about 2% molybdenum even though copper was raised from about zero to about 4%.

The ratio of transverse tear strength to yield strength which would reduce the effect of yield strength on tear strength has been calculated and tabulated. These numbers ranging from 1.2 to 1.35 show a marked increase when copper is increased. Since copper has been shown to increase the resistance to longitudinal tearing it is suggested that increased copper up to 5.5% will allow greater levels of deformation before the critical point where crack link up causes complete separation or fracture.

The importance of the yield strength or flow stress at high levels of cold work was discussed earlier. Basically there are two problems associated with high flow stress: (1) overloading the cold working machine causing die breakage or other load carrying components to fail; and (2) tube fracture. Lower levels of cold work must be used if tube splitting occurs, necessitating more stages of cold work, annealing and pickling. These additional manufacturing steps increase the cost of tubular products.

Tests have been developed to measure and quantify the resistance of metals to fracture or tearing. One such test is the Kahn tear test which is a type of notched tear test. Studies reported by others have shown that high levels of strain at low temperature causes the formation of pores or microvoids. The number of these pores or volume fractions increase with strain. At still higher levels of cold deformation the pores begin to link up, forming microscopic cracks. Further deformation and crack propagation leads to complete separation. When the maximum level of cold deformation is exceeded during the cold reducing process, fracture is in the longitudinal direction of tubing. Therefore one would expect lower fracture strength in the transverse rather than longitudinal direction for heavily cold reducted strip.

Tensile data on cold rolled parts using increasing amounts of titanium are shown in Tables III and IV.

TABLE III

Effect of Cold Work on Tensile Properties Annealed at 1950° F. (1066° C.)

| Heat No. | | As Ann | 15% CW | 20% CW | 65% CW | 71% CW |
|---|---|---|---|---|---|---|
| 1 | YS, ksi | 36. | 82.1 | 100.1 | 134.7 | 138.9 |
| (1.75% Ti) | TS, ksi | 80. | 100.1 | 113.6 | 147.1 | 155. |
| | El, % | 45. | 28.5 | 13. | 5. | 3.5 |
| | Hard Rb | 76.5 | 96. | 99. | — | — |
| | Rc | | 17. | 21. | 32. | 32.5 |
| 2 | YS, ksi | 34. | 83.6 | 112.7 | 137.3 | 145.5 |
| (2.02% Ti) | TS, ksi | 79.5 | 105.1 | 124.2 | 148.8 | 159.2 |
| | El, % | 46.5 | 25.5 | 8. | 5. | 4. |
| | Hard Rb | 74.5 | 96. | 103. | — | — |
| | Rc | | 17. | 26. | 32. | 33.4 |
| 3 | YS, ksi | 36.5 | 85.7 | 97. | 139.8 | 139. |
| (2.30% Ti) | TS, ksi | 80.5 | 107.7 | 116. | 153.1 | 158.5 |
| | El, % | 45. | 25.5 | 18. | 5. | 3.5 |
| | Hard Rb | 77. | 97. | 99. | — | — |
| | Rc | | 19. | 21. | 32. | 33. |

Ann = Annealed
CW = Cold Worked

TABLE IV

Tensile Properties of Cold Rolled Plus Aging

| Heat No. | | As Ann* | 15% CW | 20% CW | 65% CW | 71% CW |
|---|---|---|---|---|---|---|
| 1 | YS, ksi | 110 | 110.9 | 136.6 | 157.5 | 164.8 |
| | TS, ksi | 120 | 142.7 | 159.5 | 176.5 | 181.0 |
| | El, % | | 22.5 | 17.0 | 8.0 | 8.0 |
| | Hard, Rc | 25 | 30 | 34 | 39 | 40 |
| 2 | YS, ksi | 110 | 126.2 | 151.6 | 168.7 | 171.4 |
| | TS, ksi | 120 | 153.4 | 174.8 | 185.7 | 189.6 |
| | El, % | 20 | 11.0 | 7.0 | 8.0 | |
| | Hard, Rc | 23.5 | 32.5 | 38.0 | 40. | 40. |
| 3 | YS, ksi | 124 | 126.7 | 147.6 | 176.1 | 176.9 |
| | TS, ksi | 134 | 159.8 | 175.1 | 195.8 | 197.8 |
| | El, % | | 21.0 | 15. | 9.0 | 7.0 |
| | Hard, Rc | 27 | 35. | 37. | 42. | 43.5 |

*All samples aged 1350° F./1 hr, AC

When titanium was raised to 2.0%, the work hardening rate increased but no change occurred as titanium was raised to 2.3%. Accordingly, about 2.5% titanium would be considered an upper limit. The aged tensile tests results in Table IV indicate that considerably higher strengths are obtainable than 60 ksi yield strength and 120 ksi tensile strength with a low level of cold work followed by aging. Indeed, the combination of about 20% cold reduction with a slightly lower titanium content might be optimum for applications where greater strength is needed.

Table V shows the strength and ductility characteristics of hot worked squares in the annealed and aged conditions.

TABLE V

Effect of Heat Treatment on Age-Hardenable Alloys Forged 9/16 in. Squares

| Heat No. | Heat Treatment °F./hr | YS ksi | TS ksi | El % | RA % |
|---|---|---|---|---|---|
| 1 | 1750/⅓ | 39.7 | 93.2 | 46 | 65.1 |
| | 1750/⅓ + Age(1) | 87.3 | 140.6 | 27 | 52.2 |
| | 1750/⅓ + Age(2) | 112.3 | 157.2 | 22 | 34.6 |
| 2 | 1750/⅓ | 40.1 | 95.4 | 43 | 65.7 |
| | 1750/⅓ + Age(1) | 84.7 | 151.3 | 29 | 47.2 |
| | 1750/⅓ + Age(2) | 124.2 | 169.9 | 21 | 38.6 |
| 3 | 1750/⅓ | 40.5 | 97.5 | 41 | 62.8 |
| | 1750/⅓ + Age(1) | 86.4 | 159.2 | 30 | 48.3 |
| | 1750/⅓ + Age(2) | 134.4 | 180.4 | 21 | 30.9 |

Age(1) 1350° F./1 hr
Age(2) 1350° F./8 hrs FC 100° F./hr to 1150° F./8 hrs, AC

The data in Table V indicates that 60 ksi yield strength and 120 ksi tensile strength can be obtained in the hot worked condition as was shown previously for cold worked strip. Also with an appropriate heat treatment such as age (2) much higher strengths are obtainable.

In general, with regard to the titanium and aluminum levels, since they both also impart age-hardening characteristics to the instant alloy, a broad titanium plus aluminum range of about 1% to 5% (up to about 2.5% titanium plus up to about 2.5% aluminum) may be contemplated. However, titanium also imparts specific corrosion resistance to the alloy by combining with carbon and, accordingly, is preferred over aluminum which does not normally reduce aqueous corrosion, but will impart age-hardening. More particularly, up to about 2.5% titanium andd up to about 0.3% aluminum is preferable for most applications. However, alloys includng up to about 0.2% aluminum and about 1–2.5% titanium are satisfactory as well.

As the titanium-aluminum level increases, the alloy becomes increasingly age-hardenable with the formation of $\gamma'$; a face-centered cubic intermetallic phase of nickel, aluminum and titanium having the composition of $Ni_3Al$, Ti. Accordingly, in order to economically fabricate shaped articles, it is preferable to maintain the titanium plus aluminum level from about 1–4% and more preferably from about 1.2–3%.

Tests were conducted to show the effect of nickel and chromium content on selected alloys. The experimental data indicated that the tensile properties of 70% cold rolled strip were lower when the nickel content was increased from 13% nickel to 27% nickel. In light of these findings, a nickel ceiling of about 29.5% is appropriate. Higher levels would interfere with the desirable cold working characteristics of the instant alloy.

In order to substantiate the findings that the instant alloy compositional range of nickel, chromium and titanium does indeed lead to unexpected results, heats 16–24 were tested to determine their tensile and yield strengths. See Table VI.

TABLE VI

Tensile Properties of 70% Cold Rolled Strip Base Compositions Containing Approximately 4 Cu, 2 Mo

| Heat No. | Ni % | Cr % | Ti % | YS ksi | TS ksi | El. % | TS/YS Ratio |
|---|---|---|---|---|---|---|---|
| 16 | 12.86 | 14.76 | .03 | 143.4 | 151.9 | 6.0 | 1.059 |
| 17 | 17.63 | 15.68 | .04 | 132.4 | 145.0 | 5.5 | 1.095 |
| 18 | 17.98 | 19.41 | .03 | 137.8 | 150.6 | 5.5 | 1.093 |
| 19 | 18.24 | 23.47 | .03 | 136.3 | 162.0 | 6.5 | 1.189 |
| 20 | 27.03 | 16.52 | .03 | 122.5 | 140.7 | 5.5 | 1.149 |
| 23(a) | 36.18 | 16.04 | .06 | 129.5 | 146.3 | 4.5 | 1.130 |
| 24(b) | 27.49 | 15.92 | 1.64 | 134.0 | 148.1 | 5.0 | 1.105 |

(a) Average of two tensile tests.
(b) 74.5% cold reduction.

Referring to Tables I, VI and VII heats 21 and 22 are alloys 800 and 840 respectively. Heat 23 is a high nickel version of the instant alloy without titanium whereas heat 24 is an example of the instant invention. Referring to Tables I, VII and VIII heat 25 is alloy SCR-3 made to the composition reported in the Kowaka et al article referenced previously. This heat was workable. Prior to receipt of the Kowaka et al article, the only information concerning the SCR-3 alloy was in U.S. Pat. No. 4,201,574. Employing those teachings, heat 27 was made. Since Kowaka et al gives little hot or cold working guidance for heats containing molybdenum, nickel was increased to 40% Ni and chromium to 32% Cr. This heat edge cracked during hot working to $\frac{3}{4}\times 2\frac{1}{2}''$ flat. The cracked edge was removed and the balance was scheduled to be rolled with the other melts. However, the Kowaka heat split and was not salvageable. Heat 26 was made to the commercial composition of alloy 20Cb-3 taught by U.S. Pat. No. 3,168,397 and was malleable.

Moreover, to compare the instant alloy with alloys 20Cb-3 and SCR-3, titanium was added to their matrixes in order to determine the effect of the age-hardenable titanium addition. Heat 28 is alloy 20Cb-3+Ti whereas heat 29 is alloy SCR-3+Ti.

The plan was to make alloys SCR-3 and 20Cb-3 age-hardenable by adding about the same amount of titanium and then comparing the tensile properties of 70% CW strip to the instant alloy. Vacuum melted ingots were cast and hot rolled to $\frac{3}{4}\times 2\frac{3}{8}$ flats as previously. The flats were reheated to 2150° F. and hot rolled to $\frac{1}{4}\times 2\frac{3}{8}$ strip. Oxide was removed by grinding. The alloy 20Cb-3 strip was cold rolled successively 72% to 0.075 gage. However, the SCR-3+Ti split after a few cold passes at about 20% CW.

Table VII compares some of the characteristics of the other alloy systems.

TABLE VII

Tensile Properties of 70% Cold Rolled Strip of Other Cold Workable Alloys

| Alloy Name | Heat No. | % Ni | % Cr | % Mo | % Cu | % Si | % V | % Cb | % Ti | YS ksi | TS ksi | El % | TS/YS Ratio |
|---|---|---|---|---|---|---|---|---|---|---|---|---|---|
| alloy 800 | 21 | 33.22 | 20.49 | — | .39 | .34 | — | — | .50 | 143 | 156 | 3.0 | 1.091 |
| alloy 840 | 22 | 20.64 | 19.67 | — | .25 | .60 | — | — | .43 | 143.5 | 157.5 | 3.0 | 1.098 |
| SCR-3 | 25(a) | 26.54 | 23.00 | .04 | .01 | 1.89 | 1.20 | .01 | .28 | 141.8 | 161.6 | 5.0 | 1.140 |
| 20Cb-3 | 26(a) | 34.20 | 22.49 | 2.90 | 3.13 | .51 | .13 | .79 | .05 | 147.6 | 165.4 | 4.0 | 1.120 |
| 20Cb-3 + Ti | 28(a) | 34.63 | 23.34 | 2.73 | 3.07 | .52 | .04 | .78 | 1.65 | 165.3 | 179.1 | 2.5 | 1.083 |
| SCR-3 + Ti | (b) | | | | | | | | | | | | |

(a)Average of two tensile tests.
(b)SCR-3 + Ti was not salvageable.

A review of the data presented in Tables VI and VII is persuasive evidence that contrary to expectations the claimed nickel-chromium-titanium range leads to an alloy having good ductility while retaining the appropriate chemical characteristics.

Tables VI and VII list the mechanical properties of 70% cold rolled strip. A study of these tables indicates the following:

1. A preferred composition of about 4Cu, 2Mo, bal. Fe, 28Ni, 1.8Ti, 0.2Al, and 16Cr has acceptably low yield and tensile strengths.
2. Increasing the nickel content of the instant alloy base makes the alloy more difficult to roll by increasing the yield and tensile strengths.
3. The age hardening constitute titanium increases the yield and tensile strength of as-cold rolled strip (Heat 24).
4. At the 70% cold rolled level, Heat 24 still has considerably lower yield and tensile strength than any of the four non-age-hardenable alloys, 800, 840, SCR-3 or 20Cb-3.
5. Since alloy SCR-3+Ti is not apparently capable of being cold rolled to high reductions, no tensile tests were run. Indeed, the addition of titanium to alloy SCR-3 apparently renders the alloy incapable of high cold reductions needed for tube production.
6. Alloy 20Cb-3 at the 70% CW level has higher tensile properties and lower ductility than the age-hardenable instant alloy. The addition of titanium to 20Cb-3 to impart age-hardenability causes a very significant increase in the yield and tensile strength and lower ductility. Alloy 20Cb-3+Ti would be classed as a very difficult alloy to produce commercial quantities of small diameter, long length tubing. Compared to the instant alloy (Heat 24), the yield strength of 20Cb-3+Ti is 21,300 psi higher and the tensile strength 31,000 psi higher.

A major characteristic of the instant alloy system is its resistance to polythionic acid stress corrosion cracking (SCC). This is a common cause of failure of stainless steels and nickel alloys in petrochemical service. For this application alloys like SCR-3 and alloy 20Cb-3 depend upon a relatively high chromium level and/or titanium or columbium stabilization to avoid intergranular chromium depletion (sensitization) and resulting intergranaular attack. This is the reason for a high chromium level and titanium or columbium additions. When properly annealed, these alloys do not have chromium depleted grain boundaries, and as a result, resist intergranular attack in highly oxidizing acids such as nitric acid and intergranular SCC in aggressive environments like polythionic acid.

Conversely, the instant alloy has a relatively low chromium level, a moderate nickel alloy and measured titanium for workability and strength. The lower chromium level prevents the instant alloy from being stabilized, as are SCR-3 and alloy 20Cb-3, and as such is susceptible to integranular sensitization and resulting attack in nitric acid. Though alloys which suffer intergranular attack in nitric acid usually fail in polythionic acid, the instant alloy is resistant to SCC in polythionic acid. The reason for this resistance is not lack of grain boundary chromium depletion as in properly annealed SCR-3 and alloy 20Cb-3, but precipitation of TiC and presumably $Ni_3Ti$ particles which block the advance of polythionic acid cracking. Though the instant alloy corrodes in nitric acid because of intergranular chromium depletion, the presence of TiC and $Ni_3Ti$ grain boundary precipitates block the advance of SCC in polythionic acid, even with grain boundary chromium depletion present.

TABLE VIII

Polythionic Acid Stress Corrosion Cracking Test Results

| Heat No. | Alloy | Condition | Ploythionic Acid Cracking | Intergranular Attack ASTM A262, C Boiling 65% $NHO_3$ |
|---|---|---|---|---|
| 24 | Instant | CR + 2100° F./⅓ Hr, AC + 1400° F./1 Hr, AC | No | 1000 mpy |
| 25 | SCR-3 | " | Yes | 85 mpy |
| 26 | 20Cb-3 | " | Yes | 149 mpy |
| *30 | 20Cb-3 | " | Yes | 727 mpy |
| 24 | Instant | Anneal + Autogenous Weld + 1250° F./1 Hr, AC | No | — |
| ** | Type 321SS | " | Yes | — |
| ** | Type 347SS | " | Yes | — |
| 24 | Instant | Anneal + Autogenous Weld + 1250° F./1 Hr, AC + 1400° F./1 Hr, AC | No | — |
| *30 | 20Cb-3 | Anneal + Autogenous Weld + 1250° F./1 Hr, AC + 1400° F./1 Hr, AC | No | — |
| 31 | Instant | Anneal + 1250° F./1 Hr, AC | No | — |
| 4 | " | " | No | 217 |
| 5 | " | " | No | 170 |
| 6 | " | " | No | 222 |
| 7 | " | " | No | 523 |
| 8 | " | " | No | 570 |
| 9 | " | " | No | 2266 |
| 10 | " | " | No | 1210 |
| 11 | " | " | No | 401 |
| ** | Type 304SS | " | Yes | — |
| ** | Type 321SS | " | No | 137 |
| ** | Type 347SS | " | No | 43 |

*Commercial heat, composition 30 in Table I (One of two specimens cracked).
**Commercial heat, exact chemical composition not available.

The different mechanisms of polythionic acid resistance are illustrated in Table VIII where an example of the instant alloy (Heat No. 24) is found to be highly susceptible to intergranular attack in nitric acid but not to SCC in polythionic acid. Alloys SCR-3 and 20Cb-3 (Heat numbers 25 and 26 respectively) failed in polythionic acid when heat treated to increase their nitric acid rate above the normal approximately 36 mpy level. In addition, Ti and Cb stabilized type 321 and 347 SS (respectively) fail by polythionic acid cracking when welded and sensitized, Table VIII, while the instant alloy does not. This shows that the polythionic acid SCC resistance of the instant alloy is not related to nitric acid resistance (sensitization) as are SCR-3, alloy 20Cb-3 and stabilized stainless steels and would not be sensitive to heat treatment and welding effects in service.

Corrosion tests were conducted on heats 4–11. Corrosion test environments relevant to feedwater heater service and other possible applications were examined.

Table IX depicts the SCC test results in sodium chloride and sodium hydroxide solutions.

TABLE IX

Stress Corrosion Cracking Test Results - Maximum Crack Depth (mils) of Duplicate Specimens, One Month Test Period

| Alloy/Heat No. | % Cu* | % Mo* | 3% NaCl, pH4 600° F. | 50% NaOH Boiling |
|---|---|---|---|---|
| 4 | 0 | 0 | 0 | 2 |
| 5 | 0 | 2.0 | 0 | 2 |
| 6 | 4.0 | 0 | 0 | 0 |
| 7 | 3.9 | 2.1 | 0 | 0 |
| 8 | 4.0 | 2.1 | 0 | 0 |
| 9 | 5.0 | 3.0 | 0 | 3 |
| 10 | 5.0 | 3.1 | 0 | 0 |
| 11 | 4.1 | 2.1 | 0 | 0 |
| Ni—Cu alloy 400 | 32.56 | — | 0 | 0 |
| Stainless Steel 304 | — | 0.24 | 15 | 10 |

NOTE: In 3% NaCl and 50% NaOH tests, heats 4, 5, 8 and 9 were annealed and aged at 1350° F./1 hr, AC (12 aged at 1400° F./1 hr, AC), all others were tested as-annealed.

*Approximate Value

The tests show that the instant alloy is more resistant to SCC (caused by chlorides and sodium hydroxide) than 304 stainless. The relatively high nickel content of the instant alloys provides the increased chloride and caustic cracking resistance.

Table X shows general corrosion test results.

TABLE X

General Corrosion Test Results - Average of Duplicates in Annealed Condition (Corroson Rates in mpy)

| Alloy/Heat No. | % Cu* | % Mo* | 25% HCl 122° F. | 80% $H_2SO_4$ 140° F. | 95% $H_2SO_4$ 212° F. | 85% $H_2PO_4$ Boiling | 50% NaOH Boiling | Deaerated Water 600° F. |
|---|---|---|---|---|---|---|---|---|
| 4 | 0 | 0 | 1,970 | 52 | 401 | 15,000 | 0.2 | — |
| 5 | 0 | 2.0 | 156 | 30 | 221 | 6,426 | 0.4 | — |
| 6 | 4.0 | 0 | 1,489 | 10 | 99 | 6,477 | 0.1 | — |
| 7 | 3.9 | 2.1 | 148 | 2 | 160 | 61 | 0.2 | — |
| 8 | 4.0 | 2.0 | 107 | 2 | 159 | 64 | 0.1 | — |
| 9 | 5.0 | 3.0 | 112 | 2 | 142 | 54 | 0.1 | — |
| 10 | 5.0 | 3.1 | 110 | 6 | 127 | 51 | 0.1 | — |
| 11 | 4.1 | 2.1 | 146 | 2 | 192 | 60 | 0.1 | — |
| 15 | 3.4 | 2.0 | — | — | — | — | — | 0.10 |
| alloy 400 | 32.56 | — | — | — | — | — | 0.1 | 0.48 |
| Stainless Steel 304 | — | 0.24 | 24,370 | 300 | 153 | 5,000 | 129 | 0.06 |

*Approximate Value

Tables IX and X also determine the resistance of the instant alloy to environments other than that posed by feedwater heaters. Molybdenum additions of 2–3% greatly improved resistance to hydrochloric acid. Copper additions of 4% or more improved sulfuric acid resistance. The combination of copper and molybdenum appears to improve resistance to phosphoric acid. The instant alloy lends itself to chemical and petrochemical applications. Also Table X shows the superior resistance of the instant alloy compared to alloy 400 in deaerated water, the environment present in feedwater heaters.

The design strength of the alloys destined for tubular applications is usually based on the tensile strength of the alloy comprising the apparatus. In the annealed and age-hardened conditions, the instant alloy system will meet the 120 ksi minimum tensile strength usually specified by design engineers. This value compares favorably with such high strength tubular alloys as alloy 625 and alloy 801.

Tables XI and XII compare the minimum tube wall that would be allowed under the rules of the American Society of Mechanical Engineers Boiler and Pressure Vessels Code (ASME, B & PVC) assuming a constant volume of constant inside diameter. Since tubing is purchased by the length or foot this gives a direct comparison of the weight required for each alloy and therefore cost. The alloys selected for comparison are commercial alloys approved for Sec. VIII pressure vessel construction which are frequently used as tubulars in constructing heat exchangers and more specifically feedwater heaters. As can readily be seen the weight per foot of the instant alloy is considerably less than other engineering alloys. By virtuee of the thin wall the instant alloy has another important engineering advantage of high heat transfer; a very important property for heat exchanger tubing.

TABLE XI

Feedwater Heater Minimum Tube Wall For Constant Volume with ID equal to .500 in Service Conditions 700° F./5,000 psi.

| Seamless Tube Alloy | Spec | Design Allowable, psi | OD in | Min Wall, in. | lbs/ft |
|---|---|---|---|---|---|
| alloy 400 | SB163 | 20,100 | .646 | .073 | .503 |
| Type 304SS | SA213 | 11,100 | .809 | .154 | 1.102 |
| alloy 800 | SB163 | 15,900 | .694 | .097 | .644 |
| Instant alloy | — | 27,800 | .600 | .050 | .300 |
| Sea Cure ® | SA268 | (a) | — | — | — |

(a) Covered by Code Case 1922 which contains the warning that this alloy will embrittle at temperatures over 600° F.

TABLE XII

Feedwater Heater Minimum Tube Wall for Constant Volume with ID equal to .456 inches Service Conditions 525° F./4,600 psi.

| Seamless Tube Alloy | Spec | Design Allowable, psi | OD In | Min Wall | lbs/ft |
|---|---|---|---|---|---|
| C—½Mo | SA199 | 15,000 | .625 | .085 | .495 |
| 304 | SA213 | 11,800 | .690 | .116 | .728 |
| 316 | SA213 | 9,800 | .754 | .149 | .985 |
| 400 | SB163 | 21,000 | .570 | .057 | .352 |
| Sea Cure (a) | SA268 | 15,500 | .621 | .082 | .483 |
| 800 | SB163 | 16,500 | .608 | .076 | .437 |
| 600 | SB163 | 20,000 | .578 | .061 | .361 |
| Instant alloy | — | 28,600 | .538 | .041 | .223 |

(a) Welded

In order to produce objects and, more particularly, tubes which may be seamless or welded, the object or tube, made by methods known to those skilled in the art, may be subjected to a stress relieving heat treatment of about 1100° to 1400° F. (599.3°-760° C.) for an appropriate period of time. The time period is, of course, a function of the temperature selected and the section size.

In particular, the age-hardenable tubes may be drawn to final size, annealed at about 1700°-2000° F. for a suitable time, straightened, aged for about an hour at 1100°-1400° F., bent into the appropriate shape and stress relieved (which also ages the tube) at about 1100°-1400° F. for the appropriate time.

In summary, the instant alloy fulfills the following parameters:

1. It is less expensive than other alloys. This is achieved by a lower alloy content and improved cold workability requiring less manufacturing steps to make long length (>70 feet) small diameter (½ to 1 inch diameter) thin wall (0.049 inch wall) tubing.
2. Minimum yield strength of 60,000 psi. Minimum tensile strength of 120,000 psi after annealing and age-hardening.
3. Ductility to make 2 inch radius U-bend in the age hardened condition.
4. SCC resistance > type 304 stainless.
5. General corrosion resistance ≧ alloy 400.
6. Service temperature ≧ 800° F.

A suitable composition for overall strength, corrosion resistance and economy for feedwater heaters is similar to heats 8 and 24. That is, a preferred composition is about 28Ni-16Cr-4Cu-up to 0.1Al-1.8Ti-2.5Mo-bal. Fe plus the other ingredient. This composition appears to have the mechanical and corrosion properties necessary for a high pressure material. It also has excellent general corrosion resistance in hydrochloric, sulfuric and phosphoric acids. The good resistance of this composition to polythionic acid attack also indicates potential petrochemical applications.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

We claim:

1. An austenitic, polythionic acid and chloride stress corrosion cracking resistant nickel alloy, the alloy consisting essentially of about 25-29.5% nickel, about 14.5-17.5% chromium, about 1-5% titanium plus aluminum, up to about 0.75% silicon, up to about 1.5% manganese, about 2-2.5% copper, about 2-3.5% molybdenum, up to about 1% columbium plus tantalum, up to about 0.1% cerium, up to about 0.01% boron, up to about 0.2% nitrogeen, and the balance iron and trace amounts of impurities.

2. The alloy according to claim 1 including 1-2.5% titanium and aluminum no greater than about 0.3%.

3. The alloy according to claim 2 including about 1-2.5% titanium aluminum no greater than about 0.2%.

4. The alloy according to claim 1 including about 28% nickel, about 16% chromium, about 1.8% titanium, about 4% copper, about 0.1% aluminum, and about 2.5% molybdenum.

5. An article of manufacture comprising an age-hardenable, austenitic, corrosion resistant, nickel-iron-chromium alloy having a low work hardening rate and exhibiting at least 60 ksi yield strength and 120 ksi tensile strength, the alloy consisting essentially of about 25-29.5% nickel, about 14.5-17.5% chromium, about 2-3.5% molybdenum, about 2-5.5% copper, about 1-5% titanium plus aluminum, up to about 1.5% manganese, up to about 0.75% silicon, up to about 1% columbium plus tantalum, up to about 0.1% cerium, up to about 0.01% boron, up to about 0.2% nitrogen, the balance iron and trace amounts of impurities.

6. The article according to claim 5 including about 1-2.5% titanium and aluminum no greater than about 0.3%.

7. The article according to claim 6 including aluminum no greater than about 0.2%.

8. The article according to claim 5 including about 28% nickel, about 16% chromium, about 2.5% molybdenum, about 4% copper, about 1.8% titanium, about 0.1% aluminum, and about 1% manganese.

9. A polythionic acid resistant article of manufacture exhibiting at least 60 ksi yield strength and 120 ksi tensile strength consisting essentially of about 25-29.5% nickel, about 14.5-17.5% chromium, about 1-5% titanium plus aluminum, up to about 0.75% silicon, up to about 1.5% manganese, about 2-5.5% copper, about 2-3.5% molybdenum, up to about 1% columbium plus tantalum, up to about 0.1% cerium, up to about 0.05% boron, up to about 0.2% nitrogen, and the balance iron and trace amounts of impurities.

10. The article of manufacture according to claim 9 including about 1-2.5% titanium and aluminum no greater than about 0.3%.

11. The article of manufacture according to claim 10 including aluminum no greater than about 0.2%.

12. The article of manufacture according to claim 9 including about 28% nickel, about 16% chromium, about 2.5% molybdenum, about 4% copper, about 1.8% titanium, about 0.1% aluminum, and about 1% manganese.

* * * * *